United States Patent [19]

Birkmeier et al.

[11] 3,995,775

[45] Dec. 7, 1976

[54] CELLULOSIC INSULATION BLOWING MACHINE

[75] Inventors: Paul J. Birkmeier; Franklin E. Spieles, both of Delphos, Ohio

[73] Assignee: U.S. Fiber Corporation, Delphos, Ohio

[22] Filed: July 9, 1975

[21] Appl. No.: 594,563

[52] U.S. Cl. ..... 222/193

[51] Int. Cl.[2] ..... B65D 83/06

[58] Field of Search ..... 222/193, 236, 226; 302/56

[56] References Cited

UNITED STATES PATENTS

| | | | |
|---|---|---|---|
| 1,750,147 | 3/1930 | Wright | 222/193 |
| 2,740,230 | 4/1956 | Clapper | 222/193 X |
| 2,803,085 | 8/1957 | Walberg | 222/193 |
| 3,174,251 | 3/1965 | West | 222/193 |
| 3,238,919 | 3/1966 | Meyer | 222/193 X |
| 3,330,445 | 7/1967 | Love, Jr. | 222/193 |

*Primary Examiner*—Stanley H. Tollberg
*Attorney, Agent, or Firm*—Richard D. Emch

[57] ABSTRACT

A cellulosic insulation blowing machine is disclosed. The machine has a base which includes an upper horizontal floor plate. A motor driven agitator assembly is mounted above the floor plate and includes a plurality of generally horizontal cross arms which are spaced a short distance above the floor plate. The floor plate defines at least one opening adjacent the periphery of the floor plate. The opening is in communication with an enclosed housing, a blower, and an air valve. A cylindrical hopper is removably mounted on the base. The hopper includes a generally vertical wall. Insulation is placed in the top of the hopper and is urged by gravity and the cross arms towards the opening. The insulation passes through the housing to the blower which directs the insulation outwardly through a discharge conduit to a space to be insulated.

7 Claims, 7 Drawing Figures

CELLULOSIC INSULATION BLOWING MACHINE

BACKGROUND OF THE INVENTION

Cellulosic insulation is well known in the art and is used, for example, to insulate homes. For example, the cellulosic insulation is directed into the attic of the home. Cellulosic insulation is manufactured by milling waste newspaper and treating the cellulosic particles with chemicals to provide a fire retardant product.

Machines for delivering the cellulosic material to, for example, an attic, are also known in the art. It has been found that insulation delivery machines which are used, for examples, to deliver glass fiber insulation or mineral wool insulation are generally not acceptable for use in delivering cellulosic insulation.

Prior art cellulose blowing machines, which operate satisfactorily, have been quite large and complicated. These machines generally included large hoppers having vertical walls which defined a hopper chamber which was large at the top and necked inwardly to a central discharge opening at the bottom of the hopper. Because cellulosic material has a tendency to bridge, horizontal shaft agitators were vertically spaced in the prior art hoppers. These horizontal shaft agitators included paddle arms which rotated and broke up or prevented the undesired bridging of the cellulosic insulation. However, there is still a tendency for the insulation to compact and jam at the center discharge opening at the bottom of the hopper. Another major problem is that the size of the prior art cellulosic delivering machines is very bulky, requires relatively large drive motors, and are expensive. With the renewed energy conservation emphasis, it has become necessary to provide an improved cellulosic blowing machine which is adaptable for use by home owners, on a do-it-yourself basis, or small contractors.

SUMMARY OF THE INVENTION

The present invention is directed to an improved cellulosic insulation blowing machine which is readily usable by home owners and contractors. The machine includes a hopper which has generally vertical walls or walls which extend outwardly as one progresses from the top of the hopper to the bottom of the hopper. The hopper is removably mounted above a floor plate which includes one or more openings defined adjacent its periphery, as opposed to a central opening as is well known in the prior art. Motor means are mounted below the floor plate for driving a vertical shaft which extends upwardly in the center of the floor plate. A plurality of cross arms extend outwardly from the vertical rotatable shaft and urge the cellulosic material in the hopper toward the openings. The cross arms are spaced a short distance above the floor plate and are generally horizontally disposed. The machine includes a base which mounts the floor plate and has at least one coupling on its exterior which mounts a motor driven blower assembly. The opening in the floor plate is in direct communication with the intake of the blower through an enclosed housing and is also in communication with an air valve. In operation, the blower receives cellulosic material from the hopper, through the opening, and discharges the insulation materials through a conduit, for example, a flexible hose. The flexible hose is then utilized by the operator to direct the cellulosic material into the space to be insulated.

DESCRIPTION OF THE PREFERRED EMBODIMENTS

Figure 1:
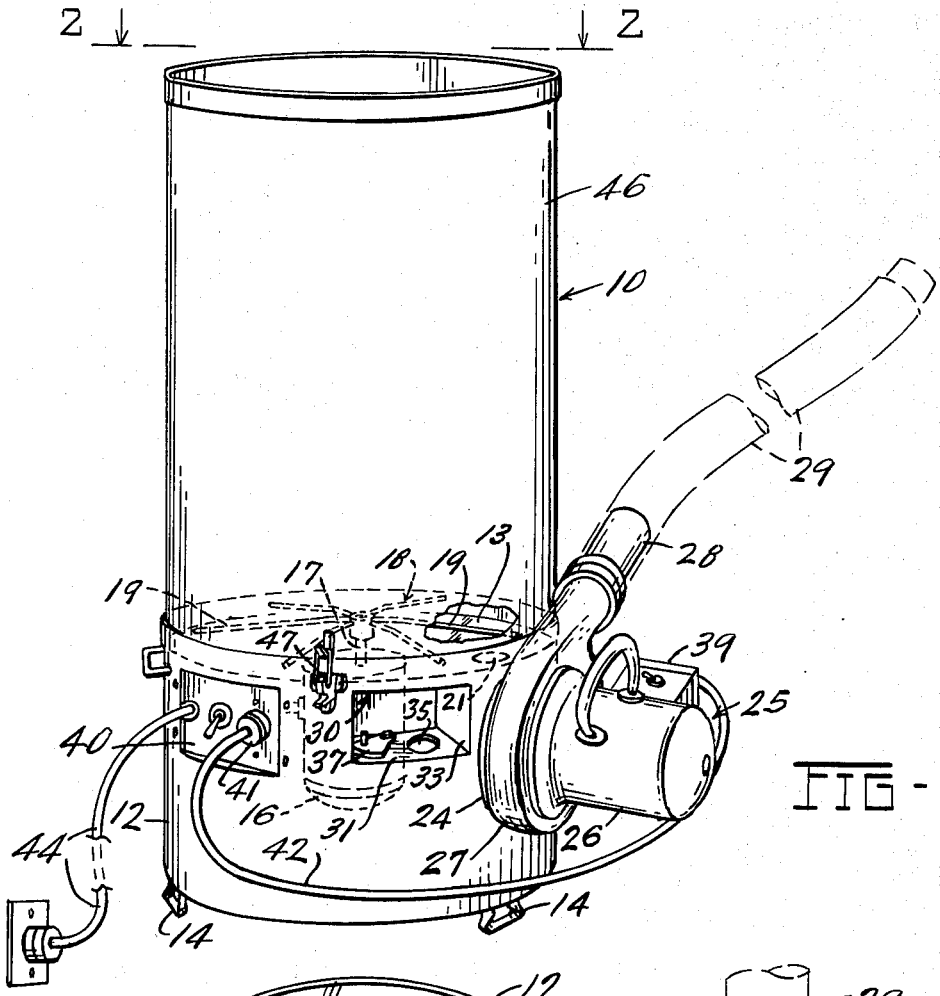
FIG. 1 is a perspective view of one embodiment of a cellulosic insulation blowing machine, according to the present invention.
Figure 2:
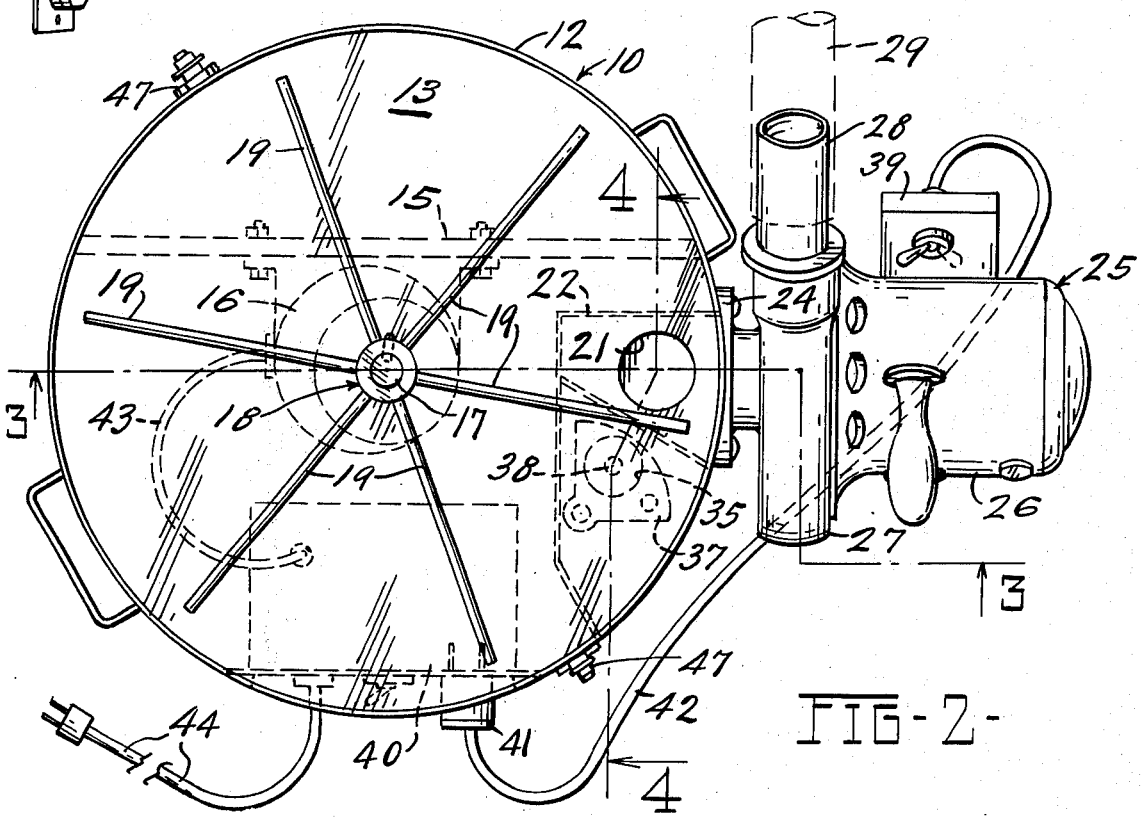
FIG. 2 is a top view, shown on an enlarged scale, of the machine shown in FIG. 1.
Figure 4:
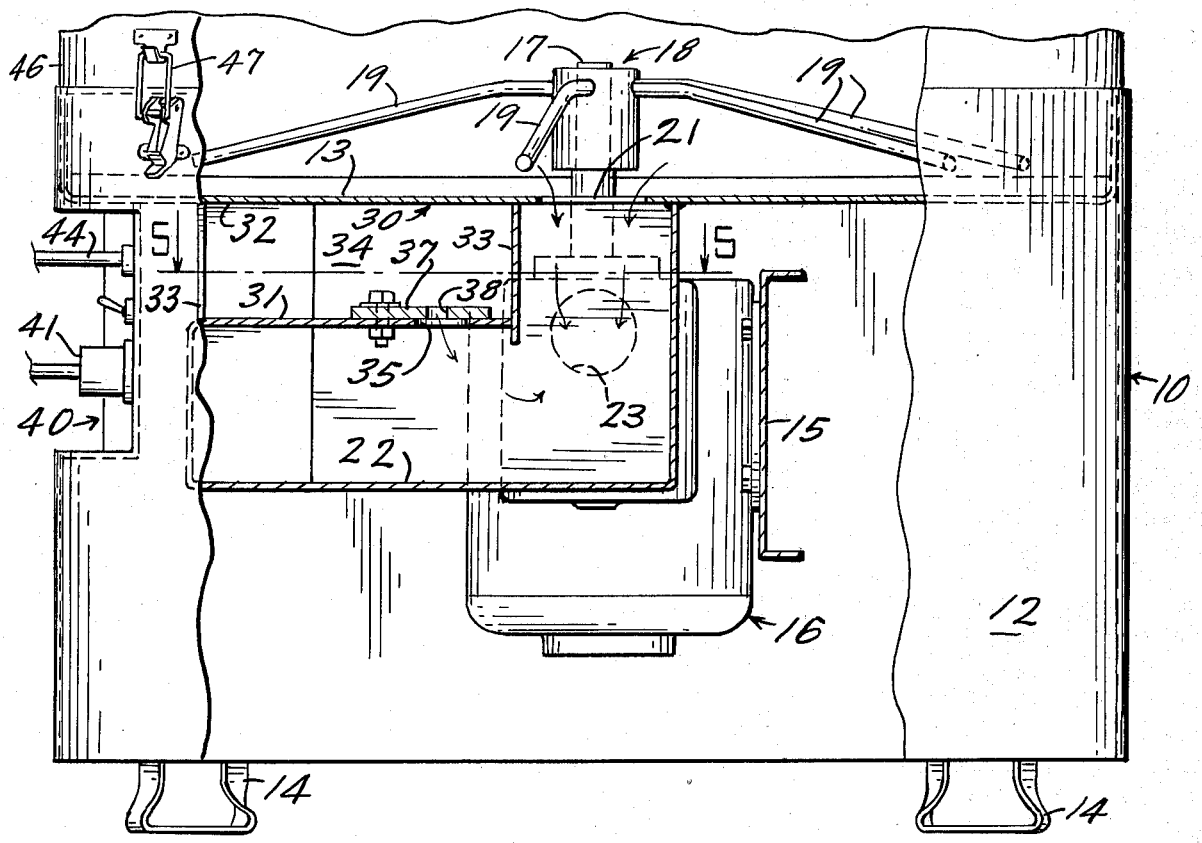
FIG. 4 is a partial sectional view, shown on an enlarged scale, taken along the line 4—4 of FIG. 2.
Figure 5:
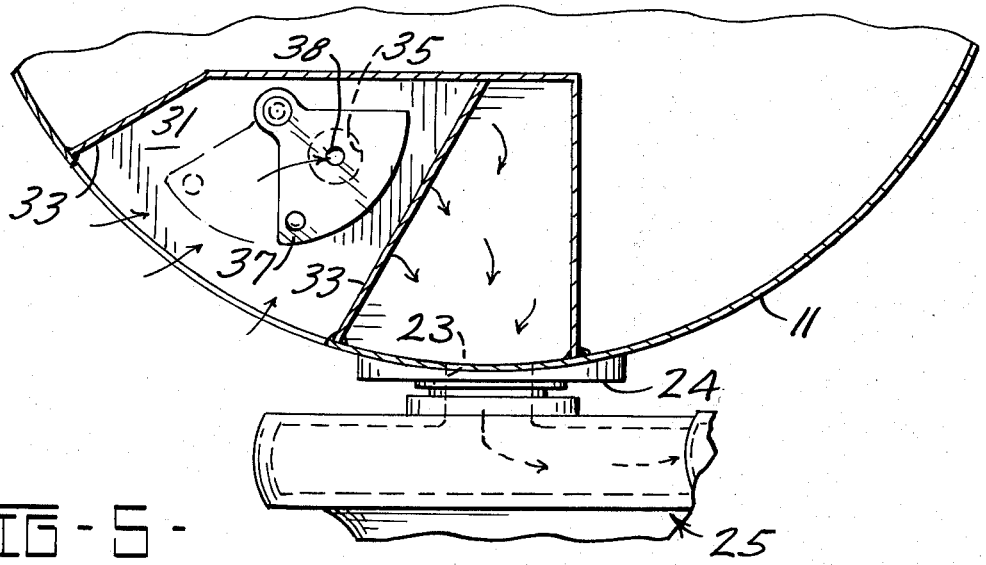
FIG. 5 is a partial sectional view, showing in particular the air valve operation, taken along the line 5—5 of FIG. 4.
Figure 6:
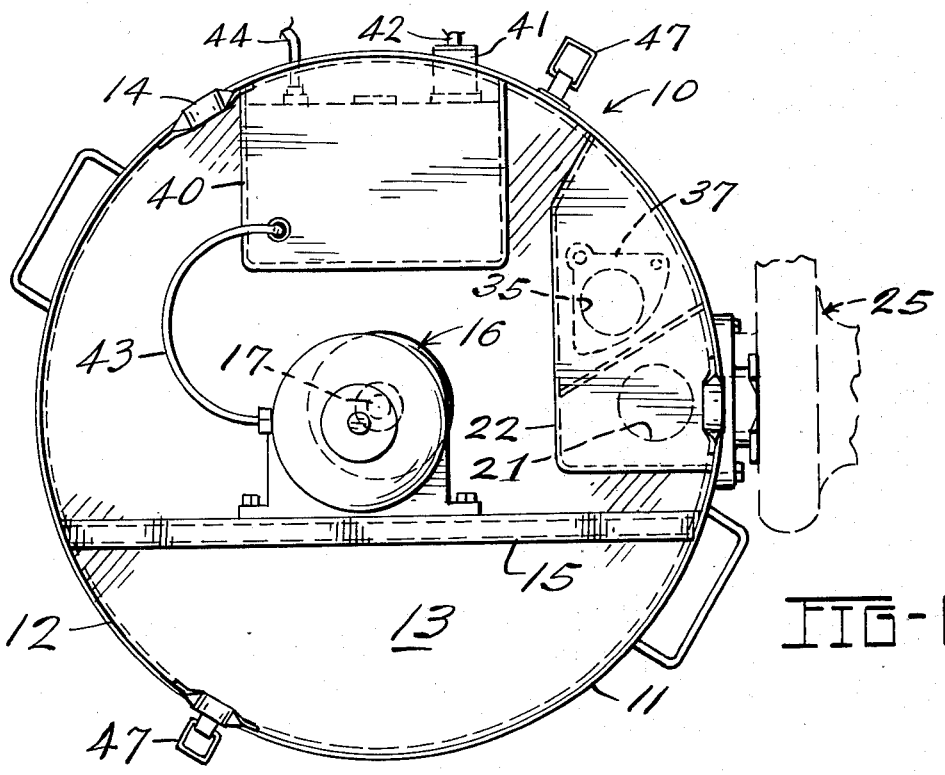
FIG. 6 is a bottom view of the cellulosic insulation blowing machine shown in FIG. 1.

A cellulosic insulation blowing machine, according to the present invention, is generally indicated in FIGS. 1–6 by the reference number 10. The blowing machine 10 includes a base 11 having a circular sidewall 12 and an upper circular floor plate 13. In the present embodiment, three feet members 14 are mounted at the bottom edge of the sidewall 12. The feet members 14 hold the sidewall 12 upwardly to allow the introduction of air to the interior of the base 11. Referring to FIGS. 2 and 6, in this embodiment, a horizontal beam 15 is connected at its ends to the interior of the sidewall 12 and mounts a motor assembly 16. The motor assembly 16 comprises a fractional horsepower motor and a gear reduction unit having a vertical output shaft 17 which extends upwardly through the floor plate 13.

Figure 3:
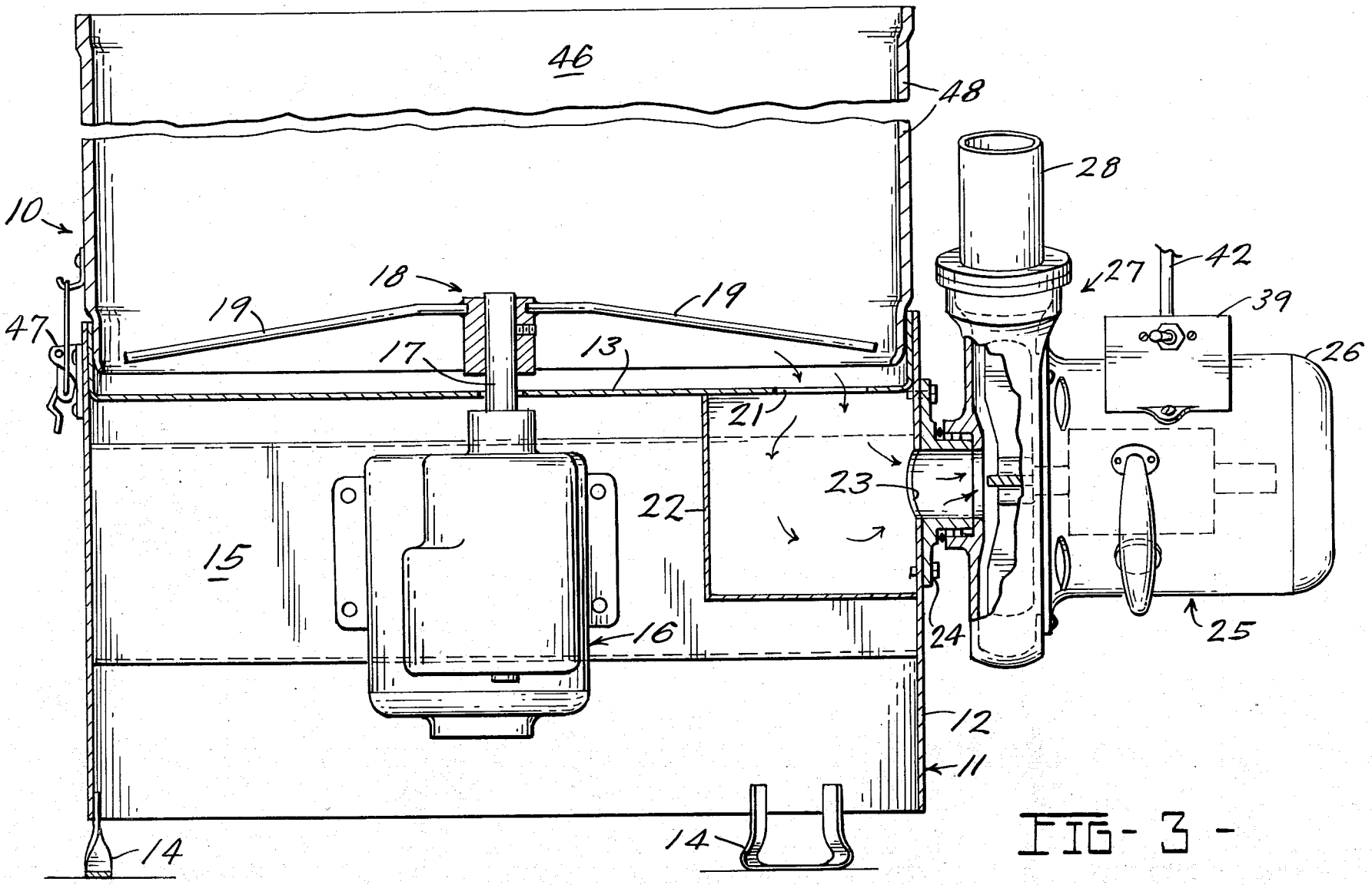
FIG. 3 is a sectional view, shown on an enlarged scale, taken along the line 3—3 of FIG. 2.

An agitator assembly 18 is mounted on the output shaft 17 and includes a plurality of generally horizontal cross arms 19. Referring to FIG. 3, the cross arms 19 are spaced a short distance above the floor plate 13, preferably no more than two inches.

Referring to FIG. 3, the floor plate 13 defines an opening 21 adjacent the sidewall 12 of the base 11. A housing 22 is connected beneath the floor plate 13 and extends to the sidewall 12 of the base 11. The housing 22 serves as a chamber or conduit between the opening 21 in the floor plate 13 and an outlet opening 23 defined in the sidewall 12. A coupling 24 is mounted on the sidewall 12 in surrounding relationship to the outlet opening 23. As shown in FIG. 3, the coupling 24 mounts a blower assembly 25, including a motor 26 and a blower 27. The blower assembly 25 includes a discharge 28 which mounts a flexible conduit or hose 29, indicated in dashed lines in FIG. 1.

Referring to FIGS. 1 and 4, a recess 30 is defined in the base 11 adjacent the housing 22. The recess 30 includes a bottom 31, a top 32, sidewalls 33 and a back 34. The bottom 31 defines an atmospheric air opening 35 which forms a path of communication between atmosphere and the interior of the housing 22. A valve plate 37 having a bleed opening 38 is pivotally mounted adjacent the atmospheric air opening 35 and is used to adjust the area of the opening 35. The bleed opening 38 in the valve plate 37 insures that some atmospheric air is always introduced through the housing 22, even when the valve plate 37 completely covers the opening 35, as shown in FIG. 5. In the present embodiment, a control box 39 is mounted on the motor 26 of the blower assembly 25 and is electrically connected to the motor 26. Similarly, a control box 40 is provided on the base 11 to control operation of the motor assembly 16. In the present embodiment, the control box 40 includes an electrical outlet 41. The control box 40 is in communication with the control box 39 through an electrical conduit 42 which is engaged with the outlet 41. An electrical conduit 43 serves as a path of electrical communication between the control box 40 and the motor assembly 16, while an electrical supply cord 44 is connected to a power source, as shown in FIG. 1.

A hopper 46, which is an important feature of the present blowing machine 10, is removably mounted on the base 11 by a pair of snap assemblies 47. The hopper 46 has a generally cylindrical sidewall 48. As opposed to most prior art blowing machine hoppers, the sidewall 48 is essentially vertical or, in the alternative, in the shape of a truncated cone with the smaller diameter at the top and the larger diameter at the bottom. An advantage of the blowing machine 10 is that with the motor assembly 16 located below the hopper 46, the hopper may be easily removed as compared to prior art cellulosic insulation blowing machines. It has been found that the hopper 46 greatly reduces bridging of the cellulosic material, particularly when combined with the agitator assembly 18 having the generally horizontally rotating cross arms 19. While the choice of materials is optional, in the present embodiment, the hopper 46 is constructed of polyethylene, while the base 11 is constructed of sheet metal. The motor assembly 16 is a small horsepower motor of much smaller size than was known in prior art cellulosic insulation blowing machines where the drive motor was utilized through a gearing or belt system to drive one or more horizontal shaft agitators. It has been found that the resulting structure, shown in the FIGS. 1–6 embodiment, results in a machine weighing approximately 55 pounds.

In operation, the cellulosic material is placed in the upper open end of the hopper 46. The motor assembly 16 is energized and the cross arms 19 rotate at a slow rpm to prevent agglomeration or bridging of the cellulosic material. The blower assembly 25 is then energized either at the control box 39 or by a remote control switch on the end of the hose 29 (not shown). The cellulosic material drops downwardly through the opening 21 in the floor plate 13, passing through the housing 22, the outlet opening 23, the blower 27, the discharge 28 and the flexible hose 29.

The density of the cellulosic insulation as it leaves the flexible hose 29, relative to the carrier air stream, may be adjusted by use of the valve plate 37. The valve plate 37 is utilized to throttle the amount of atmospheric air introduced into the housing 22 and the blower 27 through the atmospheric air opening 35.

Because the machine 10 is relatively light in weight, and relatively simple to operate, it may be rented by lumber yards and material supply houses to a homeowner. The homeowner may then utilize the machine 10 to insulate spaces in his home, thereby reducing the heat loss in his home with the concurrent saving of energy costs.

Figure 7:
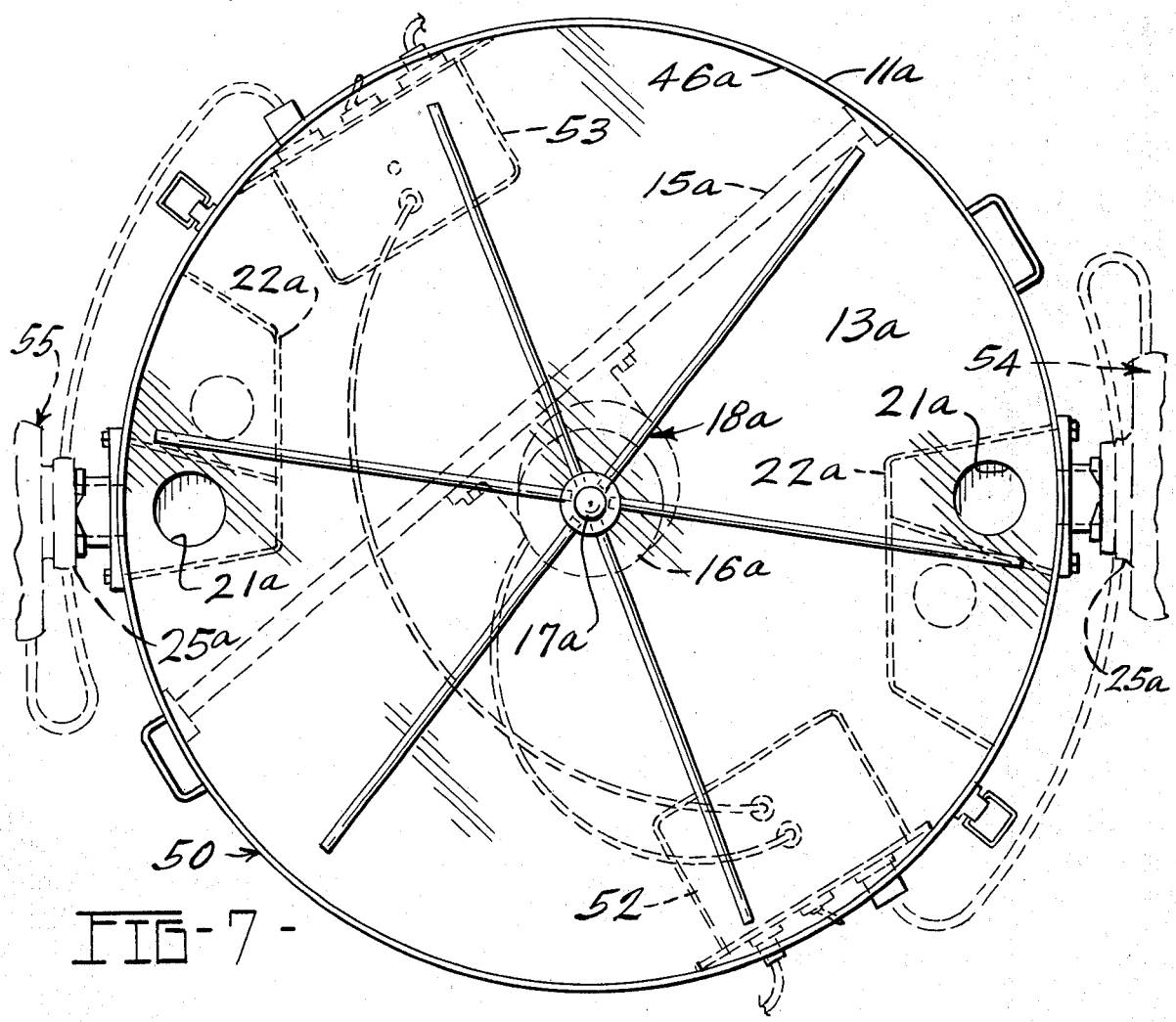
FIG. 7 is a top view, similar to FIG. 2, showing another embodiment of a cellulosic insulation blowing machine, according to the present invention.

Another embodiment of a cellulosic insulation blowing machine is generally indicated in FIG. 7 by the reference number 50. The blowing machine 50 is of a larger size and is more suitable for use by a contractor, as opposed to a homeowner. The blowing machine 50 is generally of the same configuration as the blowing machine 10, including a base **11*a*, a hopper 46*a*, a floor plate 13*a*, and an agitator assembly 18*a* which is driven by a motor assembly 16*a***.

However, in the present embodiment, the floor plate **13*a* defines a pair of material openings 21*a*, which are in communication with respective and separate housings 22*a*. Other embodiments, not shown, may include three or more openings 21*a* in the floor plate and corresponding blower assemblies. In the present embodiment, the housings 22*a*** are diametrically opposed to one another.

Control boxes 52 and 53 are provided on the base **11*a*. The control boxes 52 and 53 are connected to a power source, to the motor assembly 16*a*, and to a pair of blower assemblies 54 and 55, indicated by dashed lines in FIG. 7. The blower assemblies 54 and 55 are mounted on their respective couplings 24*a* and are operated by two separate operators. The separate blower assemblies 54 and 55 are in communication with the housings 22*a* and their discharges are connected to separate discharge hoses (not shown). In this manner, the cellulosic insulation blowing machine 50** may be utilized to insulate two remote spaces concurrently.

It has been found that blowing machines, constructed according to the present invention, provide excellent means for supplying insulation to a space or spaces to be insulated.

What we claim is:

1. A cellulosic insulation blowing machine comprising, in combination, a base including a generally horizontal floor plate and defining a material opening adjacent the periphery of said base floor plate, an agitator assembly having a plurality of generally horizontally and radially extending cross arms, motor means for driving said agitator assembly, said motor means being mounted within said base below said floor plate and including an output shaft extending through said floor plate, said agitator assembly being mounted for rotation on said output shaft, at least one blower assembly in communication with said material opening, said base including a side wall having an opening defined therethrough, a closed housing mounted adjacent said side wall, said material opening and said base side wall opening being surrounded by said housing, said blower assembly being in communication with said base side wall opening, air valve means in communication with said housing for introducing atmospheric air to said housing, a generally cylindrical hopper positioned above said floor plate and means for removably mounting said hopper on said base.

2. A cellulosic insulation blowing machine, according to claim 1, wherein said cross arms of said agitator assembly are spaced a short distance above said floor plate.

3. A cellulosic insulation blowing machine, according to claim 1, wherein said base defines at least two material openings adjacent the periphery of said floor plate, and a separate blower assembly in communication with each of said material openings.

4. A cellulosic insulation blowing machine, according to claim 1, wherein said air valve means includes an air intake opening in said closed housing and a pivotally mounted valve plate adjacent said air intake opening for adjusting the area of said air intake opening.

5. A cellulosic insulation blowing machine, according to claim 1, wherein said hopper is constructed of a plastic material.

6. A cellulosic insulation blowing machine according to claim 1, wherein said hopper mounting means comprises at least two snap assemblies operatively connected to said hopper and said base.

7. A cellulosic insulation blowing machine, according to claim 4, including means on the bottom of said base sidewall for elevating said base above its supporting surface.

* * * * *